US006287652B2

(12) United States Patent
Speckhals et al.

(10) Patent No.: US 6,287,652 B2
(45) **Date of Patent: *Sep. 11, 2001**

(54) FLUID PRODUCT SAMPLER PACKAGE WITH CLEAR MOISTURE VAPOR BARRIER FILM

(75) Inventors: Kenneth H. Speckhals, Paoli, PA (US); Anthony J. Gunderman, Phoenix, MD (US)

(73) Assignee: Color Prelude, Inc., Baltimore, MD (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/207,249

(22) Filed: Dec. 9, 1998

(51) Int. Cl.[7] ..... B32B 31/26; B32B 27/00

(52) U.S. Cl. ..... 428/35.2; 428/35.3; 428/35.4; 428/35.7; 428/36.7; 206/484; 206/484.2; 206/524.2; 206/823; 156/73.1; 156/272.2; 156/244.17

(58) Field of Search ..... 428/35.2, 35.4, 428/35.7, 36.7, 35.3; 206/484, 484.2, 524.2, 823; 156/73.1, 272.2, 244.17

(56) References Cited

U.S. PATENT DOCUMENTS

| | | | | |
|---|---|---|---|---|
| 4,493,869 | | 1/1985 | Sweeny et al. | 428/201 |
| 4,747,782 | | 5/1988 | Campbell, Jr. | 434/377 |
| 4,786,534 | | 11/1988 | Aiken | 428/34.2 |
| 4,908,252 | | 3/1990 | Carnahan et al. | 428/87 |
| 4,935,283 | * | 6/1990 | Jamison | 428/35.2 |
| 4,998,621 | | 3/1991 | Meehan | 206/466 |
| 5,160,022 | | 11/1992 | Mennella | 206/232 |
| 5,161,688 | | 11/1992 | Muchin | 206/484 |
| 5,391,420 | | 2/1995 | Bootman et al. | 428/195 |
| 5,439,172 | | 8/1995 | Comyn et al. | 239/34 |
| 5,445,821 | | 8/1995 | Brown et al. | 424/401 |
| 5,518,790 | | 5/1996 | Huber et al. | 428/35.2 |
| 5,535,885 | | 7/1996 | Daniel et al. | 206/484 |
| 5,620,758 | * | 4/1997 | Babrowicz | 428/35.2 |
| 5,622,263 | | 4/1997 | Greenland | 206/581 |
| 5,645,161 | | 7/1997 | Whitaker et al. | 206/5 |
| 5,715,849 | | 2/1998 | Vanbraekel | 132/314 |

(List continued on next page.)

OTHER PUBLICATIONS

The Condensed Chemical Dictionary, 8th Ed. p. 715, definition of "PVDC", 1971.*

"ACLAR Fluoropolymer Film Expansion on Stream", AlliedSignal Specialty Films: What's New, Nov. 30, 1998.

"Ultra–High Barrier Film for Lamination BARRIALON*–UB", Asashi Chemical.

Polyvinylidene Chloride Balanced High Barrier Film, Barrialon–UB, Asahi Chemical Industry Co., Ltd.

*Primary Examiner*—Rena L. Dye
(74) *Attorney, Agent, or Firm*—Ostrolenk, Faber, Gerb & Soffen, LLP

(57) ABSTRACT

A sampler package for fluid cosmetics, creams, gels, and the like having a liquid solvent base includes a transparent composite laminate sealed with a composite laminate having a foil barrier layer. The sealed composite laminates form a pouch in which the cosmetic sample is contained. The transparent composite laminate is preferably adhesively laminated with either a biaxially oriented PVDC film or a polychlorotrifluoroethylene film as the moisture vapor barrier layer. The moisture permeability rate of the barrier film is at most 0.065 g/100 in$^2$/24 hrs @100° F.,90% RH. Use of such transparent films as the barrier laminate permits the sampler package to be formed with a transparent window through which the color, texture, etc. of the sampler product may be viewed.

46 Claims, 3 Drawing Sheets

U.S. PATENT DOCUMENTS

| | | | | |
|---|---|---|---|---|
| 5,718,098 | | 2/1998 | Grosskopf et al. | 53/397 |
| 5,763,028 | | 6/1998 | Matsumoto et al. | 428/34.7 |
| 5,799,675 | | 9/1998 | Gunderman et al. | 132/333 |
| 5,827,583 | | 10/1998 | Ambler | 428/35.2 |
| 5,833,070 | * | 11/1998 | Mizuno et al. | 206/524.4 |
| 5,851,611 | | 12/1998 | Guttag | 428/35.7 |
| 5,918,608 | | 7/1999 | Renna | 132/320 |
| 5,919,547 | * | 6/1999 | Kocher et al. | 428/35.4 |
| 5,944,709 | * | 8/1999 | Barney et al. | 604/410 |

* cited by examiner

FLUID PRODUCT SAMPLER PACKAGE WITH CLEAR MOISTURE VAPOR BARRIER FILM

BACKGROUND OF THE INVENTION

1. Field of the Invention

The present invention relates to a sampler package for products such as cosmetics containing a fluid base such as water or other organic solvent. Examples of such products include, for example, liquid cosmetics, lotions, creams, gels, fragrances, ointments, etc.

2. Description of the Related Art

Sampler packages for cosmetics are generally well known in the art. Such samplers typically place approximately a unit dose of a powder or wax based cosmetic product on a substrate such as paperboard or the like and are distributed to potential customers via store displays, inserts in magazines, mailers, etc. Additionally, the samplers are often packaged in an attractive display having artwork or copy print printed thereon while providing a transparent or translucent window through which the consumer can view the product to thereby choose the preferred shade or color. Cosmetics having a substantially solid or highly viscous consistency such as eyeshadow, pressed powder, and lipstick are particularly suitable for these methods of distribution, as the nature of the product allows for a long shelf life. Specifically, these types of cosmetic preparations are capable of remaining compositionally stable under normal indoor environmental conditions. Thus, sampler packages for such types of cosmetic products can be readily produced which can withstand the oftentimes rigorous conditions of shipment or storage such as being stacked in magazines, etc., and which may be imposed by the consumer.

However, when the product to be sampled is more fluid such as a liquid or gel, the prior art cosmetic samplers fall short in at least one of the aspects listed above. In particular, none of the prior art samplers provide a package for a liquid based product which is non-bulky for distribution as inserts, and which allows a consumer to view the shade of the product while preventing the solvent base from evaporating quickly through the packaging material or the sealing points therebetween. Additionally, none of the prior art packages for containing fluid samples of cosmetics are flexible enough to avoid breakage in shipment and yet are rigid enough to permit high speed insertion of the sampler into the carrier medium.

In one type of prior art sampler package disclosed in U.S. Pat. No. 5,535,885 to Daniel et al., a liquid fragrance sample is disposed in a container made of gelatin which is designed to distribute compressive forces away from the portion containing the sample so as to avoid rupture during shipment or storage. This container, however, requires a relatively high ratio of material to product sample which becomes cumulatively bulky when placed as inserts in a stack of magazines or the like.

Cosmetic sampler packages made from composite laminates are capable of containing a greater amount of product relative to the amount of packaging material while also being flexible and much more compact than the package discussed above. Such packages usually contain a barrier layer made of metal foil in the composite laminates enclosing the product sample, since foil is known to be the most effective type of flexible barrier film against moisture and vapor transmission. For example, U.S. Pat. Nos. 5,518,790, 5,622,263, and 5,391,420 to Huber, Greenland, and Bootman et al., respectively, disclose the use of foil barrier layers in each of the composite laminates forming the aroma-tight and moisture sealed sampler packages for containing fluid based cosmetics. Packages which seal the product in foil laminates are particularly suitable for products such as perfumes or creams where the color or appearance of the product being sampled does not significantly affect the likelihood of purchase of the product, since the presence of the foil layer necessarily renders the package opaque.

The nature of certain cosmetics, however, such as foundation, is such that a consumer will only consider sampling, and subsequently purchasing, the cosmetic if the shade matches her skin tone or the product is otherwise to her liking. With these products, it is especially important that the sampler package provide a means for a consumer to view the product color or texture before actually opening the package so as to facilitate selection of the appropriate color. To achieve this result, sampler packages containing this type of cosmetic should include a transparent or translucent window through which the product may be viewed.

U.S. Pat. No. 4,493,869 to Sweeney et al., and U.S. Pat. No. 5,647,941 to Gunderman et al., (the latter being assigned to the assignee of the present invention), disclose fragrance and cosmetic samplers having a transparent cover film or package to enable viewing of the product. However, the transparent films traditionally used for this purpose, such as polyesters or polyvinyl resin films, are not very effective barriers against moisture and vapor transmission. As a result, the product has a tendency to substantially dry out often before the consumer has an opportunity to sample the product. To avoid this problem, the fragrance sample in the Sweeney patent is enclosed in rupturable microcapsules dispersed in a binder layer on the surface of the transparent layer. Similarly, the sampler disclosed in the Gunderman patent is disclosed as being used for products having a high viscosity where rapid solvent evaporation is generally not a problem. Thus, as demonstrated by these two examples, traditional transparent cover films are only used when other means is provided to prevent the sample from drying out.

Samplers using nonmetallic polymeric barrier layers having improved moisture vapor barrier characteristics over the previous films have been attempted in the cosmetic industry. For example, U.S. Pat. No. 5,439,172 to Comyn et al., U.S. Pat. No. 5,622,263 to Greenland, U.S. Pat. No. 5,391,420 to Bootman et al., and U.S. Pat. No. 5,645,161 to Whitaker each disclose the use of composite laminates having a polyvinylidene dichloride coated polymeric barrier layer. Although the PVDC coated films have a lower moisture vapor transmission rate than the other polymer films discussed above, such films still perform very poorly in preserving the compositional integrity of a fluid based product sample.

Another type of transparent film typically used as a moisture barrier is a SiOx coating which has a much lower moisture vapor transmission rate than the conventional films including PVDC coated films. Presently, SiOx is commonly used as a coating on PET bottles or containers. This material, however, is similar to a coating of glass, and is too rigid for use in insert-type cosmetic sampler packages which must withstand a certain degree of flexing and bending during handling. When the silane material is folded or flexed, the moisture vapor barrier properties are severely compromised due to fracturing or cracking of the silane coating.

It would be desirable to produce a sampler package for a cosmetic product which overcomes the drawbacks of the prior art noted above, namely one which is relatively flexible and transparent or translucent and provides moisture vapor barrier qualities on par with that of sampler packages which seal the product entirely in foil-containing laminates.

SUMMARY OF THE INVENTION

The present invention overcomes the deficiencies of the prior art by providing a cosmetic sampler package for a fluid product made from a composite laminate including a transparent or translucent nonmetallic barrier layer having a moisture vapor transmission rate (MVTR) substantially equivalent to that of a foil film. Specifically, the barrier film used in the present invention has a moisture vapor transmission rate of less than 0.30 g/100 in$^2$/24 hrs @100° F.,90% RH. Preferably, the barrier film has an MVTR of no greater than about 0.065 g/100 in$^2$/24 hrs @100° F.,90% RH. More preferably, the barrier film has an MVTR between about 0.02 to 0.04 g/100 in$^2$/24 hrs @100° F.,90% RH. Additionally, the film is sufficiently flexible so that it may be flexed without cracking.

One preferred material used in the present invention as the nonmetallic barrier layer is a biaxially oriented polyvinylidene chloride film which is included in the composite laminate used to form the sampler package. The structure of the biaxially oriented PVDC film provides superior moisture vapor barrier qualities, while also being thermoformable and having a high resistance to heat and humidity.

Another preferred material for the nonmetallic barrier layer is a modified fluoropolymer film, specifically a polychlorotrifluoroethylene film (PCTFE). PCTFE exhibits a moisture vapor transmission rate similar to biaxially oriented PVDC.

The use of these types of films to form the barrier layer in a composite laminate advantageously permits the production of a transparent cosmetic sampler package which is capable of maintaining the integrity of a product sample to approximately the same extent as if the product was sealed in an entirely foil based laminate package or in a capped bottle or jar. The composite laminate has a thickness which retains the necessary flexibility to withstand flexing yet provides sufficient rigidity to resist wrinkling or folding when inserted into magazines, newspapers, etc.

In the present invention, the biaxially oriented polyvinylidene chloride or polychlorotrifluoroethylene film is preferably laminated with the other layers by adhesive lamination, but may also be laminated by coextrusion. Each layer in the composite laminate is transparent or translucent, including the barrier layer film, so as to enable viewing of the color and texture of the product contained therein.

The sampler package of the present invention is suitable for use with cosmetic type products having a solvent base containing water and/or other organic solvent, including but not limited to liquid cosmetics, creams, gels, lotions, ointments, shampoos, perfumes, fragrances, etc.

Other features and advantages of the present invention will become apparent from the following description of the invention which refers to the accompanying drawings.

DETAILED DESCRIPTION OF THE PREFERRED EMBODIMENTS

Figure 1:
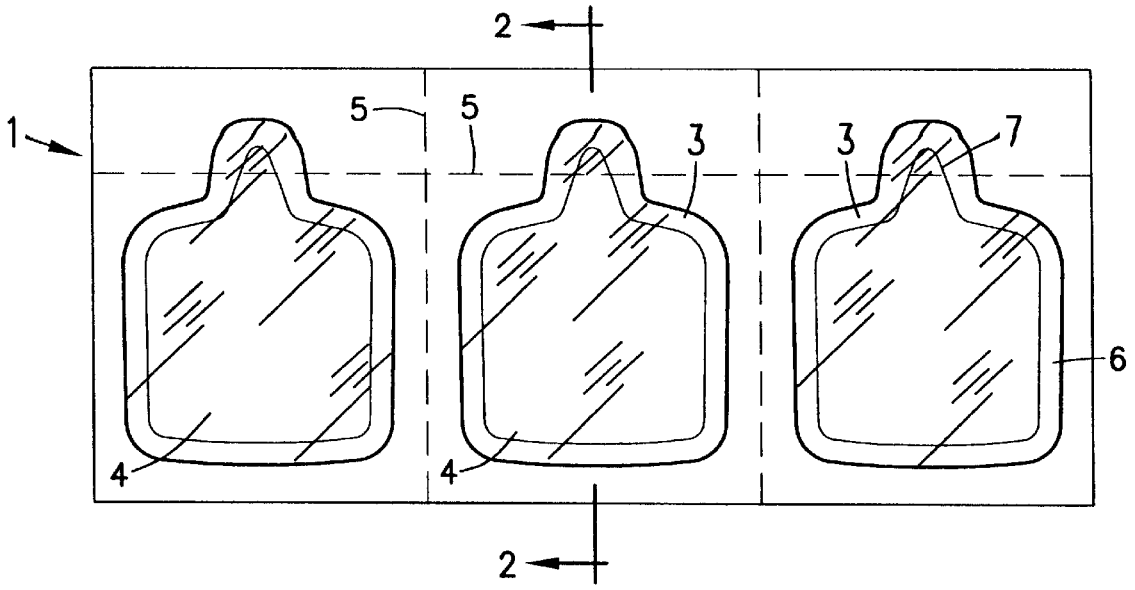
FIG. 1 shows a top view of a preferred embodiment of a sampler package according to the present invention.
Figure 2:
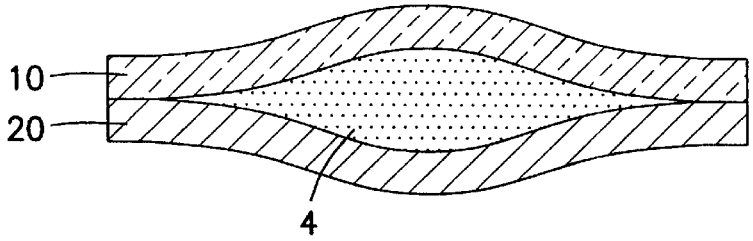
FIG. 2 shows a cross-sectional view of the sampler shown in FIG. 1 taken along the line 2—2.

FIG. 1 shows an example of a cosmetic sampler according to the present invention using the nonmetallic barrier laminates discussed above. In a preferred embodiment, a strip of sampler packages 1 includes three packages. Each sampler package has a pouch 3 containing a sample of a liquid based cosmetic product 4. Each pouch is formed by sealing a transparent or translucent composite laminate forming the cover film 10 to an opaque composite laminate forming the backing film 20 of the sampler package.

Cover film 10 contains a layer of a transparent or translucent polymeric barrier film having a moisture vapor transmission rate (MVTR) no greater than about 0.065 g/100 in$^2$/24 hrs @100° F.,90% RH. Preferably, the barrier film has an MVTR substantially competitive with that of a film of aluminum foil and between about 0.02 to 0.04 g/100 in$^2$/24 hrs @100° F.,90% RH.

Suitable materials for the moisture vapor barrier layer include a biaxially oriented polyvinylidene chloride (biax-PVDC) film, such as BARRIALON®-UB film manufactured by Asahi Chemical Industry, Co., Ltd. and distributed by Phoenix Films, Inc., or a modified fluoropolymer film such as a polychlorotrifluoroethylene (PCTFE) film familiar to those knowledgeable in the art as ACLAR®, manufactured by Allied Signal Corp. Both the biax-PVDC film and the PCTFE film have MVTR values within the desired range and are also transparent.

Figure 3A:
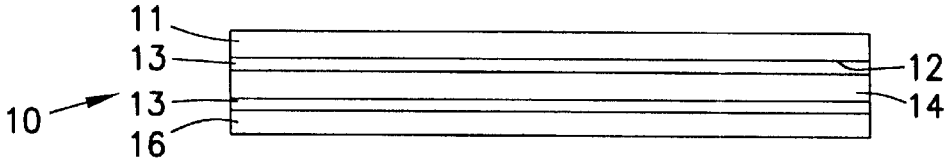
FIG. 3A shows a schematic view of the layers forming the transparent composite laminate film according to a preferred embodiment of the present invention.
Figure 3B:
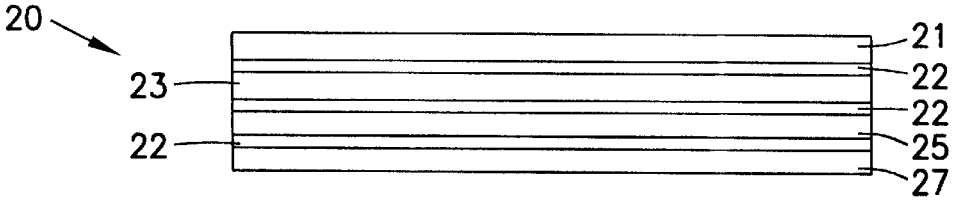
FIG. 3B shows a schematic view of the layers forming the composite laminate of the backing of a cosmetic sampler according to a preferred embodiment of the present invention.

A preferred embodiment of cover film 10 is shown in FIG. 3A and has a thickness of approximately 4.5 to 5.0 mils, with the barrier film preferably having a thickness of up to approximately 2 mils. More preferably, the barrier film is about 1 mil thick in sampler packages for most products. Cover film 10 additionally includes an exterior layer 11, and a heat seal layer 16 to enable heat sealing of the cover film 10 with the backing film 20 described below.

Exterior layer 11 is preferably made from polyester, while heat seal layer 16 is preferably made from a blend of high density and low density polyethylene. Other suitable transparent or translucent polymeric films may be substituted for exterior layer 11. Similarly, other types of heat seal layers may be used, such as polyester, which is an excellent chemically resistant barrier. Additional layers may also be included in cover film 10 in accordance with various aspects of the present invention, such as additional barrier layers and/or other films to augment the sealing layer. Each layer in cover film 10 is transparent or translucent, so as to provide a sampler package which enables viewing of the color and texture of the product to be sampled.

The various layers of cover film 10 are preferably adhesively laminated together using adhesive layers 13 made of, for example, a polyurethane adhesive. Alternatively, the cover film layers may be coextrusion laminated using tie layers made from materials such as ethylene vinyl acetate, ethylene methacrylate or ethylene vinyl alcohol. As mentioned above, additional layers may be coextruded with the barrier film and may include films made of an oriented polypropylene or linear low density polyethylene.

The plurality of layers in the composite laminate forming cover film 10 further enhances the moisture barrier properties of the foil-like MVTR of the barrier film. Moreover, the composite laminate is stiff enough to provide sufficient rigidity to resist wrinkling or folding during handling, yet retains the necessary flexibility to withstand flexing without cracking or otherwise compromising its barrier qualities.

In order to define a window through which the product sample is viewed, a window design 6 and/or copy print may be printed onto either the exterior surface of the top layer 11 using any known method of printing onto a film, or onto the interior surface thereof by reverse surface printing prior to lamination with the barrier film 14.

The backing film 20 preferably comprises a heat seal layer 21, a white polyethylene layer 23, a foil barrier layer 25, and a polyester exterior layer 27, and having a combined thickness of about 4.5–5.0 mils. Barrier layer 25 is preferably an aluminum foil film having a thickness at least about 0.20 mil (MVTR <0.01 g/100 $in^2$/24 hrs @100° F.,90% RH). As in cover film 10, heat seal layer 21 may be comprised of a high density/low density polyethylene blend or other suitable material. Similarly, additional layers may be included or suitable alternative materials may be substituted as described above.

The layers forming the composite laminate of backing film 20 are preferably adhesively laminated with adhesive layers 22 made from a material such as a polyurethane or other suitable adhesive. Alternatively, the layers of backing film 20 may be coextrusion laminated using tie layers made from materials such as ethylene vinyl acetate, ethylene methacrylate or ethylene vinyl alcohol.

In another embodiment of the present invention, the foil film may be substituted with a transparent or translucent barrier film as used in the cover film. In this embodiment, backing film 20 has a composition substantially similar to that of cover film 10, such that each layer is transparent or translucent. Backing film 20 may also contain a window design and/or copy print as described above with respect to cover film 10.

Cover film 10 and backing film 20 are sealed together to form pouch 3. In the embodiment in which both cover film 10 and backing film 20 include the transparent and translucent film as the barrier layers, the entire package can be made from one composite laminate by sealing the laminate to itself to form pouch 3. Although heat sealing is the preferred method of sealing, other sealing methods are also consistent with the present invention, such as dielectric sealing, radiant sealing, sonic sealing, high frequency sealing, etc.

In the process for forming the sampler packages shown in FIG. 1, a roll of the transparent composite laminate 10 and a roll of the foil barrier composite laminate 20 are fed to a die which seals together the heat seal layers of each composite laminate in a shape which partially forms a plurality of sampler pouches 3 along a continuous strip of sampler packages. This initial sealing process leaves a portion of each pouch unsealed, up to approximately one-half the perimeter of a finished pouch. The roll of partially heat-sealed pouches is then sent to the next processing stage, where each pouch is placed under a nozzle which fills the cosmetic sample into the pouch. When a plurality of different types or colors of cosmetic samples are to be provided in one strip of sampler packages, as in the embodiment shown in FIG. 1, a plurality of nozzles are used so that each nozzle fills a different color or cosmetic type into the respective pouch.

In one embodiment of the present invention where the sampler strips are to be distributed in magazines, mailers, or the like, each sampler package measures about 2" by 1½" and is filled with a maximum of about 350 mg of the liquid cosmetic in each pouch. For alternative means of distribution, such as department store handouts, more or less of the sample may be filled in each pouch and the size of the sampler package may be increased or decreased without varying from the scope of the invention.

After filling, the unsealed perimeter of each pouch is sealed to form a continuous strip of sealed packages. It is noted that the pouch shape includes an extended tip portion 7 for ease of dispensing the product once opened by the consumer. The roll of sealed sampler packages is then perforated by die cutting through the sealed regions between the pouches for ease of separation of the individual packages and perpendicularly thereto to form the tear-off portion 5 across the top portion 7 of each pouch. The roll of sampler packages is then cut to form strips of sampler packages for distribution, with each strip having a single or a plurality of cosmetic sample pouches. For example, the embodiment shown in FIG. 1 shows a distribution unit having three sampler packages per sampler strip.

As previously mentioned, biaxially oriented polyvinylidene chloride film (biax-PVDC) or polychlorotrifluoroethylene (PCTFE) film may be used as the moisture vapor barrier layer in at least the cover film according to one preferred embodiment of the present invention. The advantages provided by these films are demonstrated by the data shown in FIGS. 4 and 5, and in Tables I–V.

Figure 4:
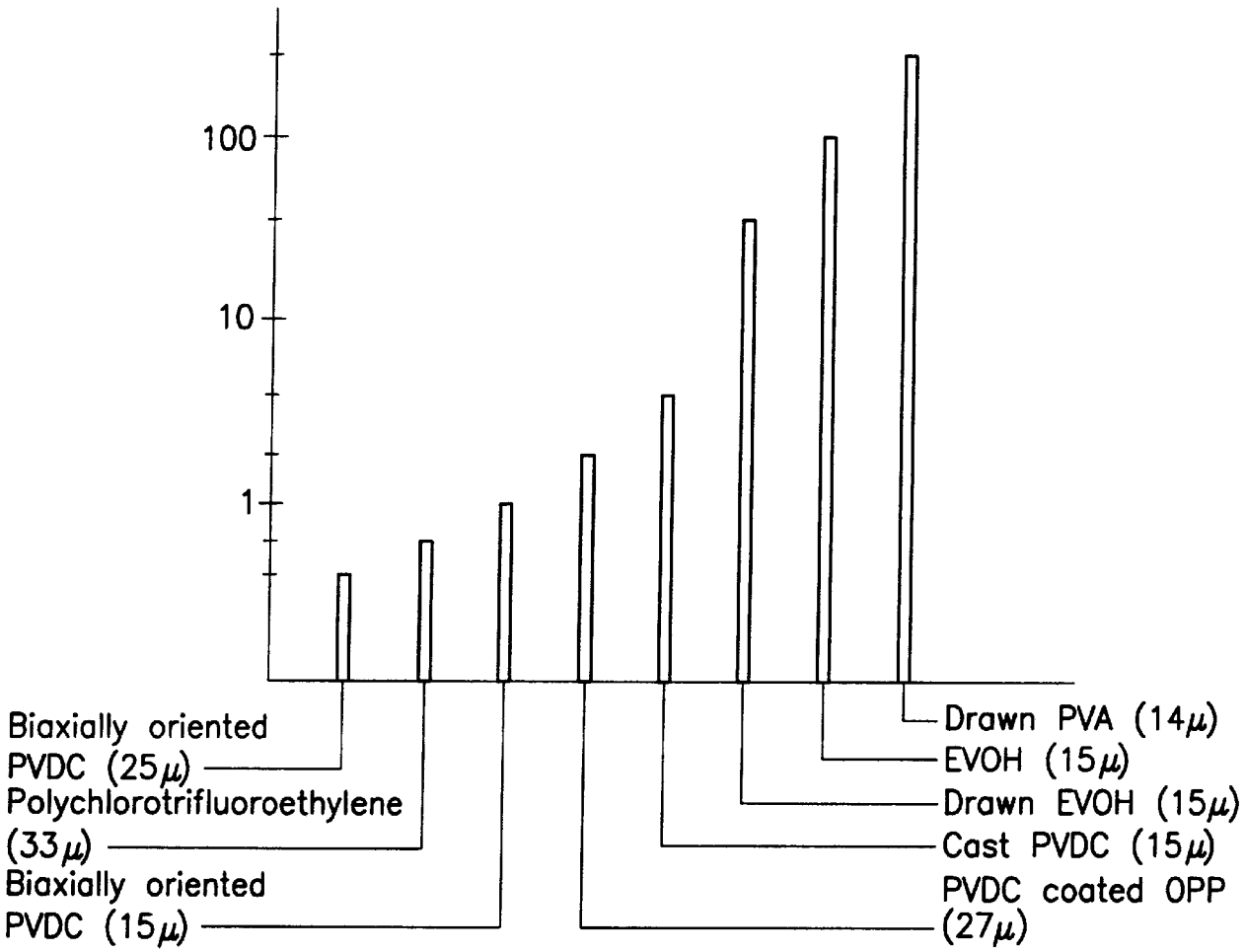
FIG. 4 shows a graphical comparison of the moisture vapor permeability of various polymeric barrier films including the barrier films used in the present invention.

FIG. 4 shows that the water vapor transmission rates of the biaxially oriented PVDC film and of the PCTFE film are much lower than typical films such as cast PVDC films and PVDC coated films used in the prior art. For example, a biax-PVDC film having a thickness of 0.6 mils (15$\mu$) has a water vapor transmission rate of about 0.065 g/100 $in^2$/24 hrs @100° F.,90% RH (1 g/$m^2$/24 hrs @40° C.,90% RH), whereas a PVDC coated oriented-polypropylene film of 1.1 mils (27$\mu$), nearly twice the thickness of the former, has a water vapor transmission rate of about 0.26 g/100 $in^2$/24 hrs @100° F., 90% RH (4 g/$m^2$/24 hrs @40° C., 90% RH). Similarly, a 1.3 mil (33$\mu$) PCTFE barrier film is shown to have an MVTR of about 0.05 g/100 $in^2$/24 hrs @100° F.,90% RH, which is substantially equivalent to that of the 1.0 biax-PVDC film.

Figure 5:
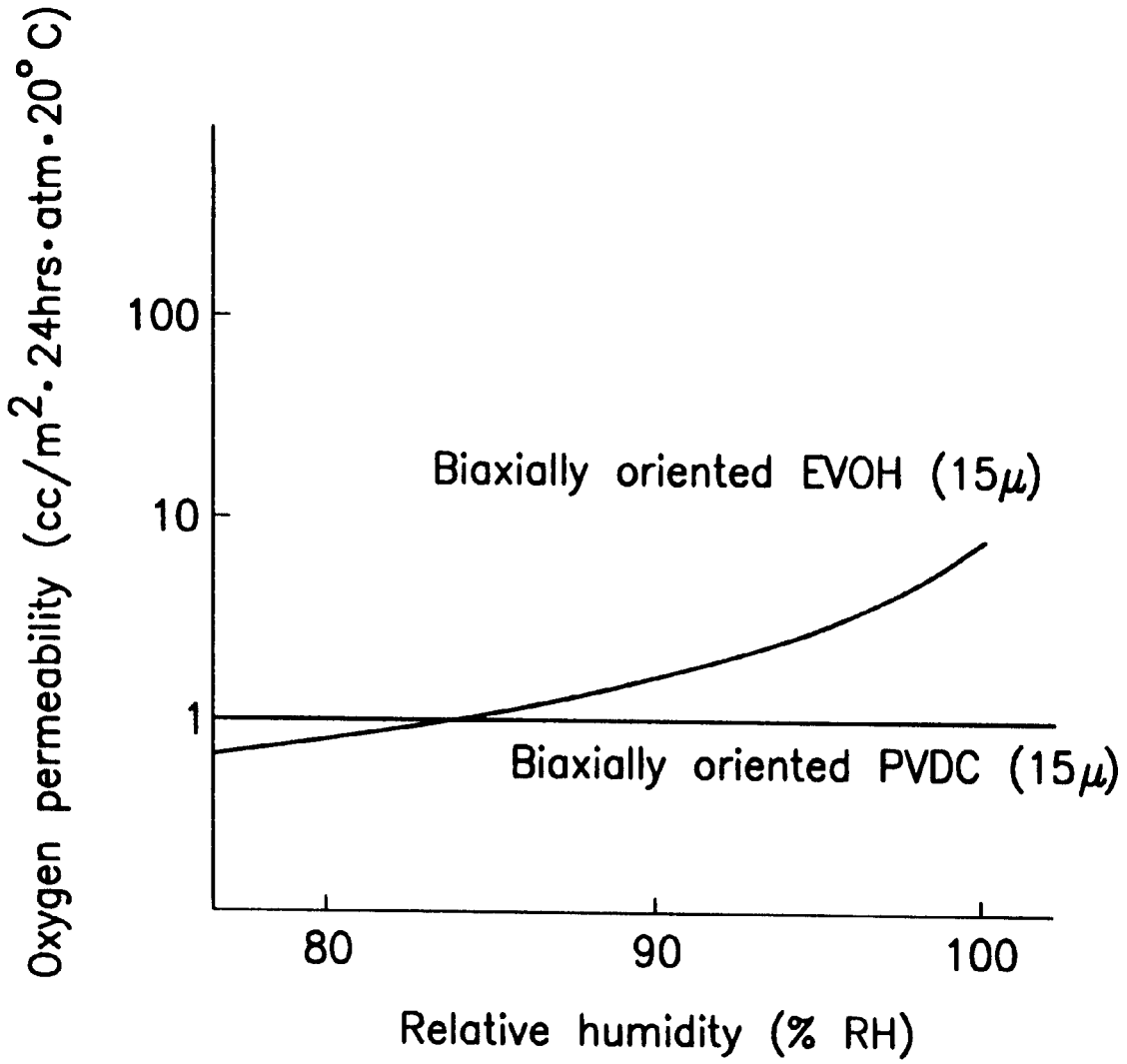
FIG. 5 shows a graphical comparison of the humidity dependency of the oxygen permeability of the barrier film used in the present invention compared to other types of known barrier films.

The oxygen transmission rate of the 0.6 mil (15$\mu$) biax-PVDC film is shown in FIG. 5 relative to percent relative humidity. Specifically, FIG. 5 shows that the oxygen transmission rate is not affected by environmental humidity.

Table I demonstrates the relationship between the thickness of the film to the moisture vapor and oxygen transmission rates.

TABLE I

| Thickness | mil ($\mu$) | 0.6 (15) | 1.0 (25) | 2.0 (50) |
|---|---|---|---|---|
| Water Vapor Transmission Rate | g/100 $in^2$/24 hrs @ 100° F., 90% RH | 0.065 | 0.04 | 0.02 |
| | (g/$m^2$/24 hrs @ 38° C., 90% RH) | (1.0) | (0.6) | (0.3) |
| Oxygen Transmission Rate | cc/100 $in^2$/24 hrs @ 73° F., atm | 0.10 | 0.06 | 0.03 |
| | (cc/$m^2$/24 hrs @ 23° C., atm) | (1.4) | (0.9) | (0.5) |

Test results comparing the moisture vapor properties of several types of composite laminates using different barrier layers are shown below in Tables II–V. For each sample, a clear laminate incorporating the specified barrier layer was sealed to itself to form a pouch having the barrier laminate as the front and back thereof, i.e. single-web construction. Four sets of each type of barrier laminate package were tested, with two sets of each type filled with water and the remaining sets filled with a liquid cosmetic product. Of the two sets of each sample type, one set was tested at 110° F. while the other set was tested at 120° F. The percentages of moisture loss by weight was obtained after one week and after two weeks.

TABLE II

| Laminate of 0.7 mil PVDC Coating on Oriented Polypropylene (% Moisture Loss by Weight) | | | |
|---|---|---|---|
| | 110° F. | 120° F. | Product |
| 1 week | 2.16–2.36 | 2.42–2.70 | water |
| 2 weeks | 4.54–5.17 | 5.09–5.95 | water |
| 1 week | 1.95–2.44 | 2.74–4.12 | liquid cosmetic |
| 2 weeks | 5.02–5.45 | 5.34–6.3 | liquid cosmetic |

TABLE III

| Laminate of 2.0 mil Aluminum Oxide (% Moisture Loss by Weight) | | | |
|---|---|---|---|
| | 110° F. | 120° F. | Product |
| 1 week | 2.1–2.94 | 2.04–4.15 | water |
| 2 weeks | 3.9–5.15 | 3.90–7.37 | water |
| 1 week | 2.24–3.49 | 2.27–3.63 | liquid cosmetic |
| 2 weeks | 4.0–6.18 | 4.06–6.48 | liquid cosmetic |

TABLE IV

| Laminate of 1.0 mil Biaxially Oriented PVDC (% Moisture Loss by Weight) | | | |
|---|---|---|---|
| | 110° F. | 120° F. | Product |
| 1 week | 1.20–1.40 | 1.39–1.58 | water |
| 2 weeks | 2.25–2.74 | 3.0–3.45 | water |
| 1 week | 1.21–1.49 | 1.63–1.80 | liquid cosmetic |
| 2 weeks | 2.67–3.14 | 3.4–3.90 | liquid cosmetic |

TABLE V

| Laminate of 1.3 mil Polychlorotrifluoroethylene Film (% Moisture Loss by Weight) | | | |
|---|---|---|---|
| | 110° F. | 120° F. | Product |
| 1 week | 1.15–1.62 | 1.25–1.85 | water |
| 2 weeks | 2.33–3.11 | 2.61–3.82 | water |
| 1 week | 0.61–0.76 | 0.66–0.88 | liquid cosmetic |
| 2 weeks | 1.25–1.47 | 1.38–1.86 | liquid cosmetic |

As can be seen from Table II, the moisture loss in the PVDC coated OPP laminate packages ranged from 4.5% to 5.5% of the original weight after two weeks at 110° F. This result is extrapolated to yield a moisture loss of over 12% after one year at room temperature.

At both test temperatures ranged from 2.25% to 3.9% of the original sample weight, as shown in Table IV. These results obtained after a test period of two weeks at 110° F. and 120° F. can be extrapolated to be equivalent to the moisture that would be lost over a period of 6–8 months at room temperature.

During testing, it was found that the moisture loss from a sample of a liquid cosmetic sealed in a single web of biax-PVDC laminate did not result in any adverse change in texture of the cosmetic when observed even after 10 months at room temperature. Thus, a single web package made from the biax-PVDC laminate easily provides a usable product sample for a minimum shelf life of six months.

Moreover, when the package is made with a foil laminate on one side, as discussed above with respect to the preferred embodiments of the present invention, the moisture loss ranged from 2.5% to 3.0% of the original sample weight for one month at 110° F. and 120° F. By extrapolation, this is the moisture loss that can be expected for a package of this construction after a period of one year at room temperature.

Table V shows that the results obtained for the PCTFE laminate packages are similar to the results obtained for the biax-PVDC packages. Specifically, the moisture loss from the PCTFE laminate packages after two weeks at 110° F. and 120° F. range from 1.25% to 3.82% of the original sample weight. Thus, the extrapolated shelf life at room temperature of the PCTFE laminated packages is comparable to the biax-PVDC based packages.

Due to the excellent gas and moisture vapor barrier properties of the sampler package containing moisture vapor barrier films having an MVTR $\leqq$0.065 g/100 in$^2$/24 hrs @100° F., 90% RH as discussed above, samples of cosmetic products having a fluid base such as water or other organic solvent may be distributed in a manner which displays the shade of the cosmetic product to the consumer through the package while maintaining the compositional integrity of the product for a much greater time period than previously obtained with cosmetic sampler packages previously used in the art.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A sampler package for a fluid product, comprising:

a first composite laminate of continuous layers including a first moisture barrier layer; and a second composite laminate of continuous layers including a second moisture barrier layer, said first and second composite laminates being sealed together to form at least one enclosed pouch for containing a sample of a fluid cosmetic product, wherein at least a portion of the first composite laminate is transparent or translucent such that the sample of the fluid cosmetic product can be viewed therethrough, and wherein the first and second moisture vapor barrier layers each has a moisture vapor transmission rate no greater than about 0.065 g/100 in$^2$/24 hrs @100° F.,90% RH, and the first moisture vapor barrier layer is a nonmetallic flexible film.

2. The sampler package as recited in claim 1, wherein the first moisture barrier layer has a moisture vapor transmission rate between about 0.02 and 0.04 g/100 in$^2$/24 hrs @100° F., 90% RH.

3. The sampler package as recited in claim 1, wherein the first moisture barrier layer has a moisture vapor transmission rate substantially equivalent to that of foil.

4. The sampler package as recited in claim 1, wherein the first moisture barrier layer is a biaxially oriented PVDC film.

5. The sampler package as recited in claim 1, wherein the first moisture barrier layer is a polychlorotrifluoroethylene film.

6. The sampler package as recited in claim 1, wherein the first moisture barrier layer has a thickness between about 0.6 mil and about 2.0 mil.

7. The sampler package as recited in claim 6, wherein the first moisture barrier layer has a thickness approximately 1.0 mil.

8. The sampler package as recited in claim 1, wherein the first composite laminate has a total thickness of between about 4.5 to about 5 mils.

9. The sampler package as recited in claim 1, wherein the first composite laminate comprises at least an exterior layer, the first moisture vapor barrier layer, and a sealing layer.

10. The sampler package as recited in claim 9, wherein the first composite laminate further comprises at least one adhesive layer.

11. The sampler package as recited in claim 9, wherein the first composite laminate further comprises at least one tie layer.

12. The sampler package as recited in claim 9, wherein the first composite laminate further comprises at least one additional layer.

13. The sampler package as recited in claim 12, wherein the at least one additional layer is made from a material selected from ethylene vinyl acetate, ethylene methacrylate, ethylene vinyl alcohol, oriented polypropylene, linear low density polyethylene, and polyurethane.

14. The sampler package as recited in claim 9, wherein the exterior layer is printed with a window design or copy print, the window design forming a window which defines a transparent or translucent portion of the first composite laminate.

15. The sampler package as recited in claim 14, wherein the window design or copy print is printed on an exterior surface of the exterior layer.

16. The sampler package as recited in claim 14, wherein the window design or copy print is printed on an interior surface of the exterior layer, the interior surface facing the first moisture vapor barrier layer.

17. The sampler package as recited in claim 9, wherein the exterior layer is made from polyester.

18. The sampler package as recited in claim 1, wherein the second moisture vapor barrier layer is a foil film.

19. The sampler package as recited in claim 18, wherein the second moisture vapor barrier layer is an aluminum foil film having a thickness of at least about 0.20 mil.

20. The sampler package as recited in claim 1, wherein the second moisture vapor barrier layer is a nonmetallic flexible film.

21. The sampler package as recited in claim 20, wherein the second moisture barrier layer is transparent or translucent.

22. The sampler package as recited in claim 20, wherein the second moisture vapor barrier layer is a biaxially oriented polyvinylidene film.

23. The sampler package as recited in claim 20, wherein the second moisture vapor barrier layer is a polychlorotrifluoroethylene film.

24. The sampler package as recited in claim 1, wherein the second composite laminate has a total thickness of between about 4.5 to about 5 mils.

25. The sampler package as recited in claim 1, wherein the second composite laminate comprises at least a sealing layer, the second moisture vapor barrier layer, and an exterior layer.

26. The sampler package as recited in claim 25, wherein the second composite laminate further comprises at least one additional layer.

27. The sampler package as recited in claim 26, wherein the at least one additional layer is made from a material selected from ethylene vinyl acetate, ethylene methacrylate, ethylene vinyl alcohol, oriented polypropylene, linear low density polyethylene, and polyurethane.

28. The sampler package as recited in claim 1, wherein the first and second composite laminates are sealed together, each of the first and second composite laminates including a sealable layer disposed such that the sealable layers are facing each other when the composite laminates are sealed.

29. The sampler package as recited in claim 28, wherein the sealable layers comprise at least one material selected from high density polyethylene, low density polyethylene, and polyester.

30. The sampler package as recited in claim 1, further comprising a fluid product sample contained in each said at least one pouch, said fluid cosmetic sampler having a solvent base selected from water, an organic solvent, and a combination thereof.

31. The sampler package as recited in claim 30, wherein the fluid product sample has a physical state of a type selected from a liquid, lotion, cream, and gel.

32. The sampler package as recited in claim 28, further comprising perforations in the sealed composite laminates to facilitate separation of individual sampler pouches or opening of the package.

33. A method for producing a sampler package for a fluid product, comprising the steps of:

forming a first composite laminate of continuous layers which includes a first moisture vapor barrier layer having a moisture vapor transmission rate no greater than about 0.065 g/100 $in^2$/24 hrs @100° F., 90% RH;

forming a second composite laminate of continuous layers which includes a second moisture vapor barrier layer having a moisture vapor transmission rate no greater than about 0.065 g/100 $in^2$/24 hrs @100° F., 90% RH; and at least partially sealing together the first and second composite laminates to form a pouch for containing the fluid product, wherein at least a portion of said first composite laminate is transparent or translucent for viewing the fluid product therethrough.

34. The method as recited in claim 33, wherein the first composite laminate comprises a plurality of layers including the first moisture vapor barrier layer and wherein the first composite laminate is formed by coextrusion lamination of the plurality of layers.

35. The method as recited in claim 33, wherein the first composite laminate comprises a plurality of layers including the first moisture vapor barrier layer and wherein the first composite laminate is formed by adhesive lamination of the plurality of layers.

36. The method as recited in claim 33, wherein the sealing step is selected from heat sealing, radiant sealing, dielectric sealing, sonic sealing, and high frequency sealing.

37. The method as recited in claim 33, wherein the sealing step includes heat sealing the first and second composite laminates together on a die, said first and second composite laminates each including a heat sealable layer disposed such that the heat sealable layers face each other during sealing.

38. The method as recited in claim 33, further comprising the step of printing a window design or copy print on an exterior layer of the first composite laminate, the window design forming a window which defines a transparent or translucent portion of the first composite laminate.

39. The method as recited in claim 38, wherein the printing step includes reverse printing the window design or copy print on an interior surface of the exterior layer, the interior surface facing toward the first moisture vapor barrier layer.

40. The method as recited in claim 38, wherein the printing step includes printing the window design or copy print on an exterior surface of the exterior layer.

41. The method as recited in claim 33, wherein the sealing step includes sealing together the first and second composite laminates at predetermined regions to leave an open end in the pouch.

42. The method as recited in claim 41, further comprising the step of filling a fluid product sample into the open end of the pouch.

43. The method as recited in claim 42, further comprising the step of completely sealing together the first and second composite laminates to form a fully sealed pouch containing the fluid product sample.

44. The method as recited in claim 42, wherein a plurality of pouches are formed by at least partially sealing together the first and second composite laminates, and wherein the step of filling includes simultaneously filling a product sample into more than one pouch at one time.

45. The method as recited in claim 44, wherein less than all of the samples filled into each of the plurality of pouches are of the same product or color.

46. The method as recited in claim 33, further comprising the step of forming perforations through the sealed together regions to facilitate separation of individual pouches or opening of the package.

* * * * *